US012345450B2

(12) United States Patent
Sun

(10) Patent No.: US 12,345,450 B2
(45) Date of Patent: Jul. 1, 2025

(54) EVAPORATOR COIL INSERT

(71) Applicant: Heatcraft Refrigeration Products LLC, Stone Mountain, GA (US)

(72) Inventor: Xi Sun, Snellville, GA (US)

(73) Assignee: Heatcraft Refrigeration Products LLC, Stone Mountain, GA (US)

( * ) Notice: Subject to any disclaimer, the term of this patent is extended or adjusted under 35 U.S.C. 154(b) by 0 days.

(21) Appl. No.: 18/516,223

(22) Filed: Nov. 21, 2023

(65) Prior Publication Data

US 2024/0085070 A1 Mar. 14, 2024

Related U.S. Application Data

(60) Continuation of application No. 17/225,415, filed on Apr. 8, 2021, now Pat. No. 11,885,539, which is a division of application No. 16/170,885, filed on Oct. 25, 2018, now Pat. No. 11,009,271.

(51) Int. Cl.

| | |
|---|---|
| ***F25B 39/02*** | (2006.01) |
| *F28F 1/10* | (2006.01) |
| *F28F 1/40* | (2006.01) |
| *F28F 1/42* | (2006.01) |

(52) U.S. Cl.

CPC ..... *F25B 39/028* (2013.01); *F28F 1/10* (2013.01); *F28F 1/40* (2013.01); *F28F 1/42* (2013.01)

(58) Field of Classification Search

CPC ... F25B 39/028; F28F 1/10; F28F 1/40; F28F 1/42

USPC ..... 62/515

See application file for complete search history.

(56) References Cited

U.S. PATENT DOCUMENTS

| | | | | |
|---|---|---|---|---|
| 3,394,736 | A | 7/1968 | Pearson | |
| 3,636,982 | A | 1/1972 | Drake | |
| 4,296,539 | A | 10/1981 | Asami | |
| 2005/0103482 | A1 | 5/2005 | Park et al. | |
| 2006/0102331 | A1 | 5/2006 | Taras et al. | |
| 2007/0122322 | A1* | 5/2007 | Te Raa | B01J 8/067 422/600 |
| 2009/0218083 | A1* | 9/2009 | Arnot | F02M 37/0082 165/184 |
| 2009/0261591 | A1* | 10/2009 | Palkes | F22B 1/006 126/643 |
| 2010/0282454 | A1 | 11/2010 | Jiang et al. | |
| 2016/0153682 | A1* | 6/2016 | Vuillerme | F24S 23/70 126/658 |

(Continued)

FOREIGN PATENT DOCUMENTS

| | | |
|---|---|---|
| EP | 2148161 A2 | 1/2010 |
| EP | 2148161 A3 | 1/2014 |

(Continued)

OTHER PUBLICATIONS

European Patent Office, Extended European Search Report, Application No. 19194183.0, dated Mar. 11, 2020, 8 pages.

(Continued)

*Primary Examiner* — Joel M Attey

(57) ABSTRACT

In one embodiment, an apparatus includes an insert for an evaporator coil. The insert is a curved wire located within the evaporator coil. The insert for the evaporator coil reduces refrigerant charge in the evaporator coil and causes refrigerant flowing through the evaporator coil to change direction.

11 Claims, 5 Drawing Sheets

(56) References Cited

U.S. PATENT DOCUMENTS

| | | | | |
|---|---|---|---|---|
| 2016/0231065 | A1* | 8/2016 | Kironn | F28F 1/422 |
| 2020/0132347 | A1 | 4/2020 | Sun | |

FOREIGN PATENT DOCUMENTS

| | | | |
|---|---|---|---|
| WO | 2008060270 | A1 | 5/2008 |
| WO | 2013023279 | A1 | 2/2013 |

OTHER PUBLICATIONS

European Patent Office, Communication Pursuant to Article 94(3) EPC, Application No. 19194183.0, Mar. 9, 2022, 8 pages.

* cited by examiner

500 TABLE

| | COLUMN 510 | COLUMN 520 | COLUMN 530 | COLUMN 540 | COLUMN 550 | COLUMN 560 | COLUMN 570 |
|---|---|---|---|---|---|---|---|
| | OUTSIDE DIAMETER OF COIL 105 | INSIDE AREA OF COIL 105 | SIZE OF INSERT 110 | AREA OF INSERT 110 | LESS VOLUME % | NOTES | SHAPE |
| ROW A | 3/8" (0.375") | 0.0759 in^2 | 0.1875"X0.1875" (3/16") | 0.03515 in^2 | 46.3% | HALF OF DIAMETER OF COIL | |
| ROW B | 3/8" (0.375") | 0.0759 in^2 | D1=0.155", D2=0.0778" | 0.03784 in^2 | 49.86% | HALF OF DIAMETER OF COIL | |
| ROW C | 3/8" (0.375") | 0.0759 in^2 | a=0.311", b=0.155" | 0.03796 in^2 | 50% | a=2b | |

*FIG. 5*

EVAPORATOR COIL INSERT

CROSS-REFERENCE TO RELATED APPLICATIONS

The application is a continuation of U.S. patent application Ser. No. 17/225,415 filed on Apr. 8, 2021, now U.S. Pat. No. 11,885,539, issued Jan. 30, 2024 by Xi Sun, and entitled "EVAPORATOR COIL INSERT," which is a divisional of U.S. patent application Ser. No. 16/170,885 filed Oct. 25, 2018, now U.S. Pat. No. 11,009,271, issued May 18, 2021 by Xi Sun, and entitled "EVAPORATOR COIL INSERT," each of which are hereby incorporated by reference in their entirety.

TECHNICAL FIELD

This disclosure generally relates to an insert, and more specifically to an insert for an evaporator coil.

BACKGROUND

Certain refrigerants used in heating, ventilation, and air conditioning (HVAC) systems raise environmental concerns. For example, Class I and II refrigerants have substances that may deplete the ozone layer. Due to these environmental concerns, legislation is phasing out certain refrigerants and recommending other natural, non-toxic refrigerants such as hydrocarbon that are free of ozone-depleting properties.

SUMMARY

According to an embodiment, an apparatus includes an insert for an evaporator coil. The insert is located within the evaporator coil. The insert for the evaporator coil reduces refrigerant charge in the evaporator coil and causes refrigerant flowing through the evaporator coil to change direction.

According to another embodiment, a system includes an evaporator coil and an insert for the evaporator coil. The insert is located within the evaporator coil. The insert for the evaporator coil reduces refrigerant charge in the evaporator coil and causes refrigerant flowing through the evaporator coil to change direction.

According to yet another embodiment, a method includes locating an insert within an evaporator coil. The insert for the evaporator coil reduces refrigerant charge in the evaporator coil and causes refrigerant flowing through the evaporator coil to change direction.

The insert for the evaporator coil described in this disclosure may provide one or more of the following technical advantages. The insert reduces the volume within the evaporator coil by up to 70 percent, which may reduce the charge of refrigerant (e.g., hydrocarbon refrigerant) for the refrigerant system. The evaporator coil insert may increase the velocity of the refrigerant in the evaporator coil, which may improve oil return under certain conditions (e.g., a low temperature, part load condition). The evaporator coil insert may cause the refrigerant in its liquid and vapor form to change direction as it flows through the evaporator coil, which may increase the Reynolds (Re) number. The Re number is a dimensionless value that measures the ratio of inertial forces to viscous forces and describes the degree of turbulent flow. A low Re number indicates smooth, constant, fluid motion, whereas a high Re number indicates turbulent flow. Increasing the Re number may improve the efficiency of the refrigerant system. The evaporator coil insert is adaptable since it can be cut for any length of coil and sized to fit into any coil opening. Manufacturing the evaporator coil insert may be cost efficient since it is manufactured separate from the evaporator coil. The evaporator coil insert may be manufactured using existing production tooling.

The evaporator coil insert reduces the volume within the evaporator coil, which reduces the volume of refrigerant that can be received by the evaporator. The reduced volume of refrigerant may result in reduced cost of refrigerant. The evaporator coil insert is versatile in that it may be used by different evaporator units. The evaporator coil insert may reduce the refrigerant charge for any refrigerant system, which may assist the refrigerant system in satisfying refrigerant charge limits.

The size of evaporator coil insert may be optimized for gas regions. For example, the size of the evaporator coil insert may be larger in regions of the evaporator coil (e.g., an inlet of the evaporator coil) that will experience a flow of refrigerant in its liquid form and smaller in regions of the evaporator coil (e.g., an outlet of the evaporator coil) that will experience a flow of refrigerant in its vapor form. The evaporator coil insert may include different materials. For example, the core of the evaporator coil insert may be made of copper and the support legs for the evaporator coil insert may be made of a combination of copper and Teflon. The number of support legs for the evaporator coil insert may vary depending on the application. The core of the evaporator coil insert may be solid or hollow to balance objectives. For example, the core may be solid to reduce the volume of refrigerant flow in the evaporator coil. As another example, the core of the evaporator coil insert may be hollow to reduce cost and weight of the evaporator coil insert.

Other technical advantages will be readily apparent to one skilled in the art from the following figures, descriptions, and claims. Moreover, while specific advantages have been enumerated above, various embodiments may include all, some, or none of the enumerated advantages.

BRIEF DESCRIPTION OF THE DRAWINGS

To assist in understanding the present disclosure, reference is now made to the following description taken in conjunction with the accompanying drawings, in which:

FIG. 5 illustrates example reductions in refrigerant charge based on the size of an evaporator coil insert relative to the size of the evaporator coil.

DETAILED DESCRIPTION

Certain refrigerant systems use evaporators to convert refrigerant from its liquid form into a vapor. Legislation may require that the refrigerant system maintain a certain refrigerant charge. For example, for hydrocarbon (e.g., R290) refrigerants, legislation may limit the amount of charge to 150 grams per system. This disclosure includes an insert for an evaporator coil of a refrigerant system that reduces refrigerant charge of the system by reducing the volume in the evaporator coil.

Figure 1:
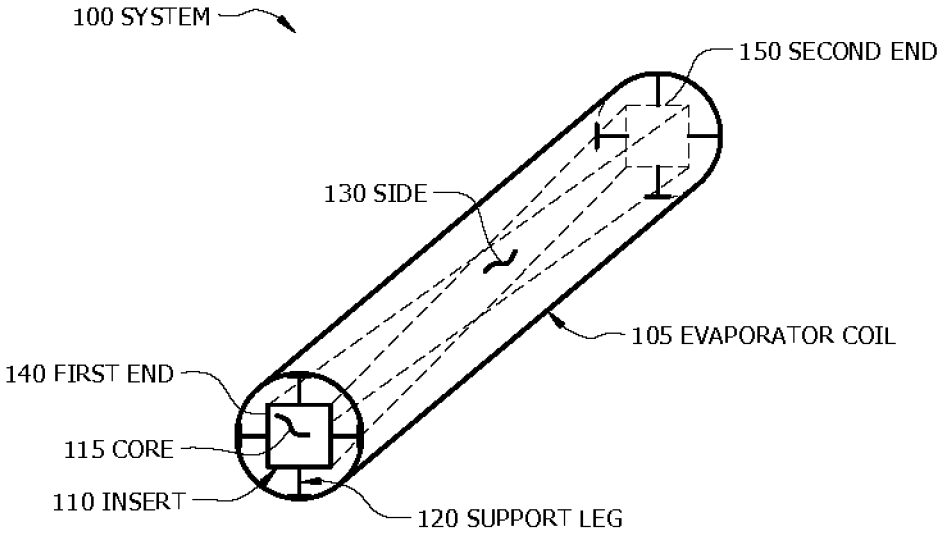
FIG. 1 illustrates an example insert for an evaporator coil of a refrigerant system.
Figure 2:
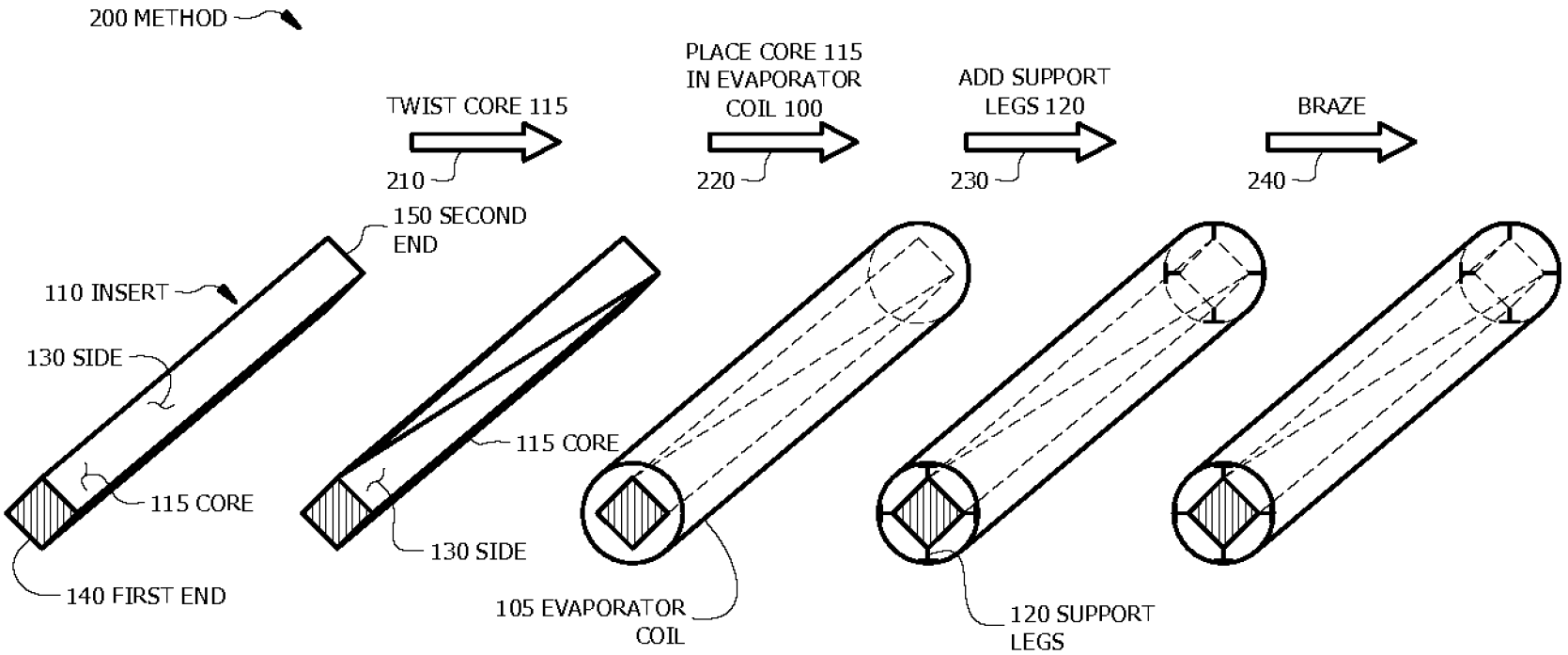
FIG. 2 illustrates an example method for installing the insert of FIG. 1 into the evaporator coil.
Figure 3A:
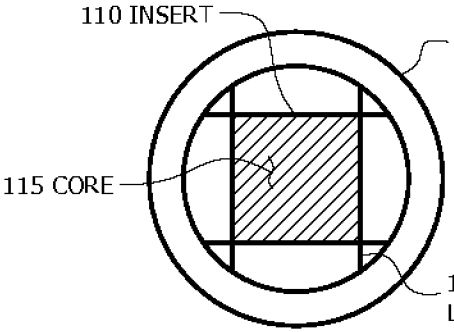
FIGS. 3A through 3E illustrate different types of inserts for an evaporator coil.
Figure 3B:
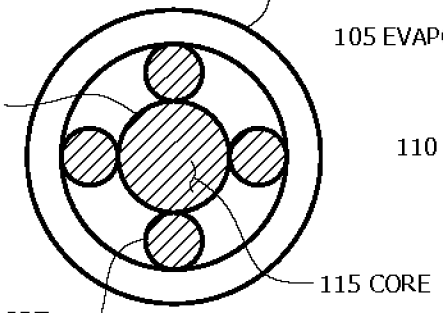
Figure 3C:
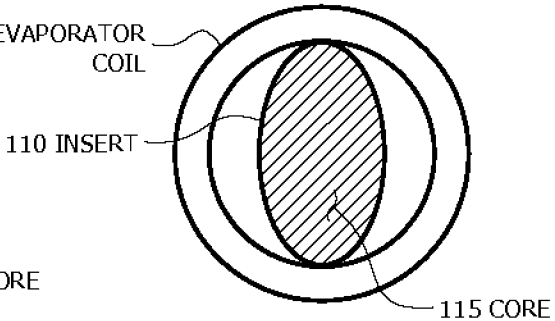
Figure 3E:
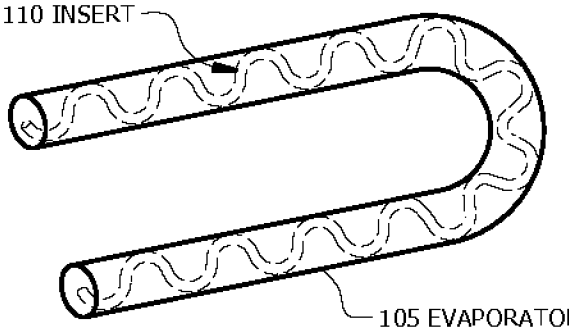
Figure 3D:
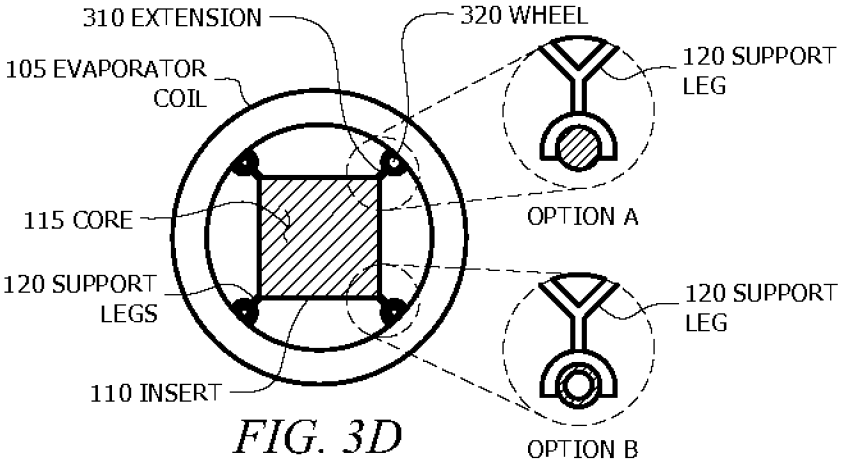
Figure 4:
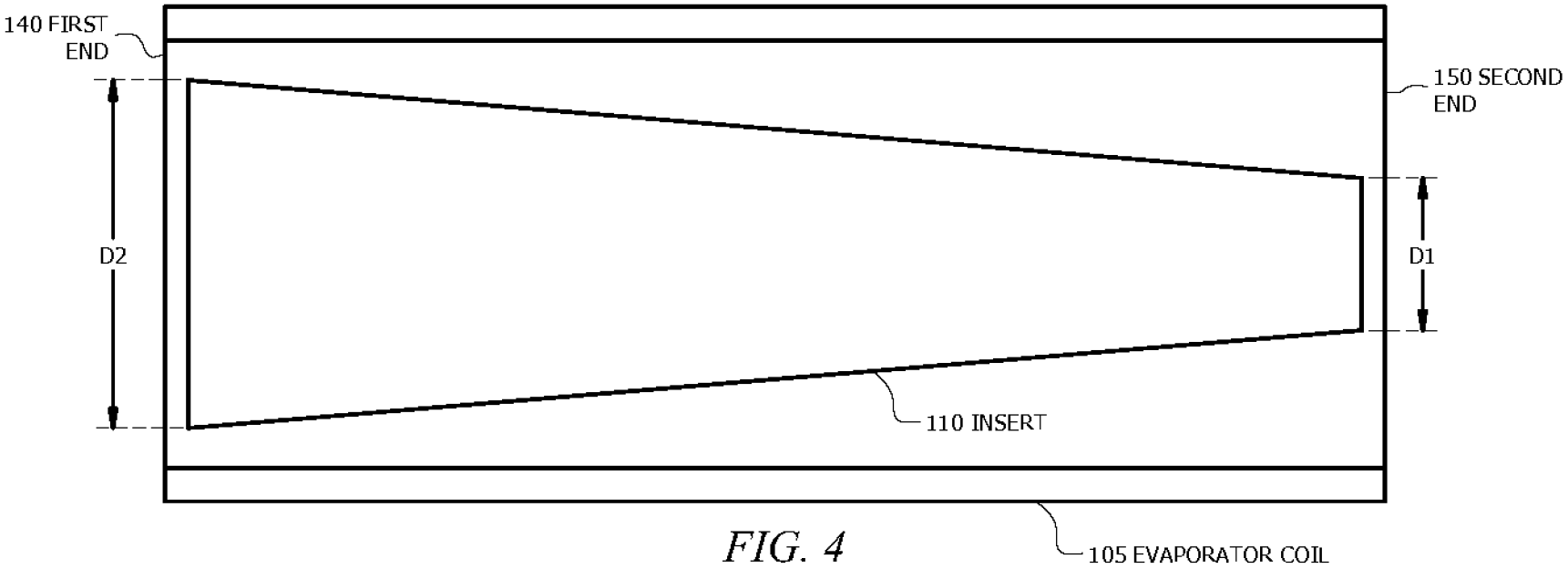
FIG. 4 illustrates example dimensions for an evaporator coil insert.

FIGS. 1 through 5 show example inserts for an evaporator coil of a refrigerant system. FIG. 1 shows an example system for an evaporator coil insert and FIG. 2 shows an example method for installing the evaporator coil insert of FIG. 1 into the evaporator coil. FIGS. 3A through 3E show different types of inserts for the evaporator coil and FIG. 4 shows example dimensions for an evaporator coil insert. FIG. 5 shows example reductions in refrigerant charge based on the size of the evaporator coil insert relative to the size of the evaporator coil.

FIG. 1 illustrates an example system 100 for an evaporator coil insert 110. System 100 includes evaporator coil 105 and insert 110. Evaporator coil 105 may be part of an air conditioner or heat pump of a refrigerant system. Evaporator coil 105 may be located within an air handler of the refrigerant system and/or attached to a furnace of the refrigerant system. Evaporator coil 105 may be used in commercial and/or residential refrigerant systems. Evaporator coil 105 holds refrigerant (e.g., hydrocarbon refrigerant). The refrigerant within evaporator coil 105 may change from a liquid to a vapor as it absorbs heat from the surrounding air. Evaporator coil 105 may be any size suitable for refrigerant flow in system 100. For example, an outer diameter of evaporator coil 105 may be in the range of ⅜ inch to ⅝ inch and a length of each evaporator coil 105 may range from 4 inches to 30 inches. Evaporator coil 105 may include one or more bends to accommodate one or more changes in direction. Evaporator coil 105 may include one or more fittings (e.g., a U-shaped fitting) to accommodate one or more changes in direction.

Insert 110 of evaporator coil 105 is any physical form that can be inserted into evaporator coil 105. Insert 110 may be made of copper, steel, aluminum, a polytetrafluoroethylene (PTFE) based formula such as Teflon, rubber, any other suitable material, or a combination of the preceding. Insert 110 comprises a core 115 and support legs 120. Core 115 may be a solid or hollow core. Core 115 may be any suitable shape. For example, a cross-sectional area of core 115 may be a square, a rectangle, a circle, an oval, or a cluster of shapes (e.g., circles). In the illustrated embodiment of FIG. 1, core 115 is a solid core with a cross-sectional area in the shape of a square that has four equal sides 130.

Insert 110 has a first end 140 and a second end 150. Core 115 is twisted along its length such that each side (e.g., side 130) of first end 140 is rotated 90 degrees from the corresponding side (e.g., side 130) of second end 150. The twisted shape of core 115 within evaporator coil 105 redirects refrigerant within evaporator coil 105, which causes the refrigerant flowing through evaporator coil 105 to change direction. This change in direction may increase the turbulence of the refrigerant in evaporator coil 105. For inserts 110 with solid cores 115, the refrigerant flows in its liquid and/or vapor form between the outer surface of solid core 115 and an inner surface of evaporator coil 105. For inserts 110 with hollow cores 115, the refrigerant flows in its liquid and/or vapor form within solid core 115 and between the outer surface of hollow core 115 and the inner surface of evaporator coil 105.

Insert 110 includes four support legs 120. Each support leg 120 is attached to a side 130 of core 115 of insert 110. For example, support leg 120 may be attached to first end 140 of insert 110 at a midpoint of side 130. Each support leg 120 may contact an inner surface of evaporator coil 105. Support legs 120 of insert 110 are used to stabilize insert 110 within evaporator coil 105. Support legs 120 may secure insert 110 within evaporator coil 105. For example, an end of support leg 120 may be brazed (i.e., soldered) to an inner surface of evaporator coil 105. As another example, an end of support leg 120 may be made of a flexible material such as Teflon or rubber and secured within evaporator coil 105 using friction, compression, or a combination thereof. In some embodiments, support leg 120 may be a spring that presses against the inner surface of evaporator coil 105. Support leg 120 may be located at the end of evaporator coil 105 or inside evaporator coil 105.

Insert 110 of evaporator coil 105 reduces the volume within evaporator coil 105, which reduces the refrigerant charge within evaporator coil 105. Refrigerant charge is a charge required for stable operation of a refrigerant system (e.g., an HVAC unit) under certain operating conditions. Refrigerant charge may be measured in grams per circuit. For example, a charge limit for a hydrocarbon refrigerant may be 150 grams per system.

In operation, core 115 of insert 110 is twisted 90 degrees and placed within evaporator coil 105 of system 100. Support leg 120 is attached to each end of core 115 on each side of core 115. Each support leg 120 is brazed to an inner surface of evaporator coil 105 to stabilize insert 110 within evaporator coil 105. As such, insert 110 of system 100 of FIG. 1 reduces refrigerant charge in evaporator coil 105 by reducing the volume within evaporator coil 105. Insert 110 of system 100 also causes refrigerant flowing within evaporator coil 105 to change direction, which improves the efficiency of the heat transfer of system 100.

Although this disclosure describes and depicts the components of system 100 arranged in a particular order, this disclosure recognizes that system 100 may include (or exclude) one or more components and the components may be arranged in any suitable order. For example, insert 110 of system 100 may include more or less than four sides 130. As another example, insert 110 may be located within evaporator coil 105 without support legs 120. As still another example, insert 110 may include support legs 120 along the length of core 115, such as at a midpoint of core 115. As yet another example, insert 110 may be twisted more or less than 90 degrees (e.g., 45 degrees or 180 degrees). As still another example, evaporator coil 105 may include one or more bends or elbows. Although FIG. 1 illustrates a particular number of evaporator coils 100, inserts 110, cores 115, support legs 120, ends 140 and 150, and sides 130, this disclosure contemplates any suitable number of evaporator coils 100, inserts 110, cores 115, support legs 120, ends 140 and 150, and sides 130.

FIG. 2 illustrates an example method 200 for installing insert 110 of FIG. 1 into evaporator coil 105. At step 210 of method 200, core 115 of insert 110 is twisted 90 degrees. Core 115 may be twisted by rotating second end 150 90 degrees respective to first end 140. Prior to twisting core 115, side 130 of core 115 faces one direction. After twisting core 115, side 130 of core 115 faces a first direction at first end 140 and a second direction at second end 150. In certain embodiments, core 115 may be twisted more or less than 90 degrees (e.g., 45 degrees or 180 degrees).

At step 220 of method 200, core 115 of insert 110 is placed inside evaporator coil 105. Insert 110 may be entirely located within evaporator coil 115. Insert 110 may be the same length as evaporator coil 115. In the illustrated embodiment of FIG. 2, core 115 of insert 110 is placed within evaporator coil 105 such that an air gap exists between the outer surface of core 115 and the inner surface of evaporator coil 105. In some embodiments, core 115 may be placed within evaporator coil 105 such that one or more sides, edges, or corners of core 115 contact the inner surface of evaporator coil 105. For example, core 115 of insert 110 may be sized such that each of the four edges along the length of core 115 contact the inner surface of evaporator coil 105.

At step 230 of method 200, support legs 120 are added to core 110. In the illustrated embodiment of FIG. 2, a support leg 120 is added to each corner of core 115 at first end 140 and second end 150. In some embodiments, support legs 120 may be added to one or more sides of core 115. Support legs 120 may be located at any suitable location along the length of core 115. Support legs may be attached to core 115 by any suitable method. For example, support legs 120 may brazed or glued to an outer surface of core 115. In certain embodiments, core 115 and support legs 120 may be manufactured as one component.

At step 240, support legs 120 are brazed to the inner surface of evaporator coil 105. Brazing support legs 120 to the inner surface of evaporator coil 105 stabilizes insert 110 within evaporator coil 105. In some embodiments, support legs 120 may be secured to the inner surface of evaporator coil 105 using a different method than brazing. For example, support legs 120 may be glued to the inner surface of evaporator coil 105. As another example, support legs 120 may include springs that press against the inner surface of evaporator coil 105.

Modifications, additions, or omissions may be made to method 200 depicted in FIG. 2. Method 200 may include more, fewer, or other steps. For example, step 240 directed to brazing insert 110 to evaporator coil 105 may be eliminated. Steps may also be performed in parallel or in any suitable order. For example, step 210 directed to twisting core 115 may occur after step 220 directed to placing core 110 within evaporator coil 105. As another example, step 230 directed to adding support legs 120 to insert 110 may occur prior to step 220 directed to placing core 115 within evaporator coil 105. One or more steps of method 200 may be performed by a machine (e.g., a robot) or by a human.

FIGS. 3A through 3E illustrate different types of inserts 110 for evaporator coil 105. FIG. 3A shows a cross-sectional view of insert 110 that functions as a plug support, which may be suitable for shorter lengths of evaporator coil 105 where no inside support is required. Insert 110 of FIG. 3A is a hatched configuration that includes core 115 and support legs 120. Core 115 has a square cross-sectional area with four equal sides. In the illustrated embodiment, core 115 is made of a solid material. In some embodiments, core 115 may be hollow. Insert 110 of FIG. 3A includes two support legs 120 at each of the four corners of core 115. The two support legs 120 at each corner are located at a 90 degree angle from each other. Core 115 and support legs 120 of FIG. 3A may be made of the same material. Core 115 and support legs 120 of FIG. 3A may be manufactured as one integral component. Support legs 120 contact an inner surface of evaporator coil 105. Friction and/or compression between support legs 120 and the inner surface of evaporator coil 105 stabilize insert 110 within evaporator coil 105 as refrigerant flows through evaporator coil 105. Insert 110 of FIG. 3A does not require brazing to secure insert 110 within evaporator coil 105. Insert 110 may be twisted along a length of evaporator coil 105.

Insert 110 of FIG. 3B is a round cluster insert 110 that includes a central core 115 and four support legs 120. Core 115 has a cross-sectional area in the shape of a circle. The cross-sectional area of core 115 is smaller than the cross-sectional area of the opening of evaporator coil 105 as measured from the inner surface of evaporator coil 105. Each support leg 120 has a cross-sectional area in the shape of a circle. The cross-sectional area of each support leg 120 is smaller than the cross-sectional area of core 115. Core 115 and support legs 120 of FIG. 3B may be made of the same material. Core 115 and support legs 120 of FIG. 3B may be manufactured separately or as a single component. Core 115 contacts each support leg 120 along a length of core 115 and support leg 120. Core 115 and support legs 120 may be attached (e.g., brazed or glued) to each other. An outer edge of each support leg 120 contacts an inner surface of evaporator coil 105 along the length of evaporator coil 105. Friction and/or compression between support legs 120 and the inner surface of evaporator coil 105 stabilize insert 110 within evaporator coil 105 as refrigerant flows through evaporator coil 105. Insert 110 of FIG. 3B does not require brazing to secure insert 110 within evaporator coil 105. One or more components of insert 110 may be twisted along a length of evaporator coil 105.

Insert 110 of FIG. 3C includes core 115 that has a cross-sectional area in the shape of an oval. The cross-sectional area of core 115 is smaller than the cross-sectional area of the opening of evaporator coil 105 as measured from the inner surface of evaporator coil 105. Two outer edges along the length of core 115 of FIG. 3C contact an inner surface of evaporator coil 105. Friction and/or compression between the outer edges of core 115 and the inner surface of evaporator coil 105 stabilize insert 110 within evaporator coil 105 as refrigerant flows through evaporator coil 105. Insert 110 of FIG. 3C does not require brazing to secure insert 110 within evaporator coil 105. Insert 110 may be twisted along a length of evaporator coil 105.

Insert 110 of FIG. 3D includes a central core 115 and four support legs 120. Core 115 has a cross-sectional area in the shape of a square having four equal sides. The cross-sectional area of core 115 is smaller than the cross-sectional area of the opening of evaporator coil 105 as measured from the inner surface of evaporator coil 105. Each support leg 120 of FIG. 3D includes an extension 310 and a wheel 320. Each extension 310 extends from a corner of core 115 such that each extension 310 is at a 135 degree angle to the two sides of core 115 that form the respective corner. Core 115 and each extension 310 of each support leg 120 may be made of the same material (e.g., copper). Core 115 and extensions 310 of FIG. 3B may be manufactured as one integral component.

Extension 310 of FIG. 3D may include a support for wheel 320 of support leg 120. The support may be curved such that it takes the shape of a semi-circle. Each wheel 320 of each support leg 120 may have a cross-sectional area in the shape of a circle. Wheel 320 is located within the support of extension 310. The support may act as a clamp to secure wheel 320 to the support. As shown in options A and B of FIG. 3D, wheel 320 of support leg 120 may be solid or hollow, respectively. Wheel 320 may be made of a flexible material (e.g., Teflon) such that the hollow shape of option B allows wheel 320 to flex more than the solid shape of option A. Friction and/or compression between wheels 320 of support legs 120 and the inner surface of evaporator coil 105 stabilize insert 110 within evaporator coil 105 as refrigerant flows through evaporator coil 105. Insert 110 of FIG. 3D does not require brazing to secure insert 110 within evaporator coil 105. Insert 110 may be twisted along a length of evaporator coil 105.

Insert 110 of FIG. 3E is a wire type insert that has a cross-sectional area in the shape of a circle. Insert 110 of FIG. 3E curves within evaporator coil 105 at 180 degree turns. The curves of insert 110 create semi-circle shapes such that an outer edge of a peak of each semi-circle of insert 110 contacts the inner surface of evaporator coil 105. Insert 110 may be made of a soft material to simplify installation. For example, insert 110 may accommodate bends in evaporator coils 100 with little or no complications. Insert 110 of FIG. 3E does not require brazing to secure insert 110 within evaporator coil 105.

Although FIGS. 3A-3E describe and depict the components of inserts 110 arranged in a particular order, this disclosure recognizes that inserts 110 may include (or exclude) one or more components and the components may be arranged in any suitable order. For example, insert 110 of FIG. 3A may include support legs 120 at the midpoint of each side of core 115. As another example, insert 110 of FIG. 3B may include more or less than four support legs. As still another example, insert 110 of FIG. 3C may have a cross-sectional area in the shape of a triangle or a quatrefoil. Although FIG. 1 illustrates a particular number of evaporator coils 100, inserts 110, cores 115, and support legs 120, this disclosure contemplates any suitable number of evaporator coils 100, inserts 110, cores 115, and support legs 120.

FIG. 4 illustrates example dimensions for insert 110 of evaporator coil 105. FIG. 4 is a cross sectional view of insert 110 and evaporator coil 105. Insert 110 of FIG. 4 has a cross-sectional area in the shape of a circle. The diameter D2 of the cross-sectional area at first end 140 of insert 110 is greater than the diameter D1 of the cross-sectional area at second end 150 of insert 110. The reduction in diameter from first end 140 to second end 150 of evaporator coil 105 may improve the efficiency of the refrigerant system by reducing the pressure drop along evaporator coil 105. For example, first end 140 of refrigerant coil 100 may be an inlet and second end 150 of refrigerant coil 100 may be an outlet. Refrigerant entering the inlet of evaporator coil 105 at first end 140 is primarily in liquid form (e.g., 90 percent liquid and 10 percent vapor). As the refrigerant flows within evaporator coil 105, it vaporizes such that the refrigerant is in vapor form at the second end 150. As the refrigerant changes to vapor, its volume increases, causing an increase in pressure. Decreasing diameter D2 at second end 150 (e.g., the outlet of evaporator coil 105) may allow the vapor to exit evaporator coil 10 with little or no complications.

FIG. 5 illustrates example reductions in refrigerant charge based on the size of insert 110 relative to the size of evaporator coil 105. Table 500 of FIG. 5 includes the following columns: column 510 showing the outside diameter of evaporator coil 105, column 520 showing an inside cross-sectional area for evaporator coil 105, column 530 showing a size of insert 110 of evaporator coil 105, column 540 showing a cross-sectional area of insert 110 of evaporator coil 105, column 550 showing a percentage volume drop of evaporator coil 105 after locating insert 110 within evaporator coil 105, column 560 showing notes regarding the different configurations of inserts 110, and column 570 showing a shape of insert 110. Table 500 includes rows A, B, and C. Column 510 of table 500 lists the outside diameter of evaporator coil 105 as ⅜ inch (i.e., 0.375 inches) for rows A, B, and C. Column 520 of table 500 lists the inside area of evaporator coil 105 as 0.0759 square inches for rows A, B, and C.

Row A shows the percentage volume drop of evaporator coil 105 after locating an insert 110 with a square shape, as shown in column 570 of row A, within evaporator coil 105. In some embodiments, the square insert 110 of row A is core 115 of FIG. 1. As shown in columns 530 and 540 of table 500, square insert 110 of row A has a size of 0.1875 inches by 0.1875 inches and an area of 0.03515 square inches. After locating square insert 110 within evaporator coil 105, the volume for refrigerant flow within evaporator coil 105 decreases by approximately 46 percent, as indicated in column 550 of row A. As noted in column 560 of row A, the length and width of insert 110 are each half the outside diameter of evaporator coil 105.

Row B shows the percentage volume drop of evaporator coil 105 after locating an insert 110 with a round cluster shape, as shown in column 570 of row B, within evaporator coil 105. In some embodiments, round cluster insert 110 of row B is insert 110 of FIG. 3B, which includes round core 115 and four round support legs 120. As shown in column 530 of table 500, round core 115 of insert 110 of row B has a diameter of 0.155 inches and each round support leg 120 of insert 110 has a diameter of 0.0778 inches. As shown in column 540 of FIG. 3B, round cluster insert 110 of row B has an area of 0.03784 square inches. After locating round cluster insert 110 within evaporator coil 105, the volume for refrigerant flow within evaporator coil 105 decreases by approximately 50 percent, as indicated in column 550 of row B. As noted in column 560 of row B, the diameter of core 115 and two support legs 120 of insert 110 are approximately half the outside diameter of evaporator coil 105.

Row C shows the percentage volume drop of evaporator coil 105 after locating an insert 110 having an oval shape, as shown in column 570 of row C, within evaporator coil 105. In some embodiments, oval insert 110 of row C is insert 110 of FIG. 3C. As shown in columns 530 and 540 of table 500, oval insert 110 of row C has a length "a" of 0.311 inches, a width "b" of 0.0.155 inches, and an area of 0.03796 square inches. After locating round cluster insert 110 within evaporator coil 105, the volume for refrigerant flow within evaporator coil 105 decreases by 50 percent, as indicated in column 550 of row C. As noted in column 560 of row C, length "a" is equal to twice the width "b" of oval insert 110.

In certain embodiments, the cross-sectional area of one or more shapes of inserts 110 shown in column 570 of rows A, B, and C of table 500 may be reduced. For example, the width and length of square insert 110 of row A at an inlet of evaporator coil 105 may be twice the width and length, respectively, of square insert 110 of row A at the outlet of evaporator coil 105. Reducing the size of insert 110 in this manner may save approximately 70 percent of refrigerant charge.

Herein, "or" is inclusive and not exclusive, unless expressly indicated otherwise or indicated otherwise by context. Therefore, herein, "A or B" means "A, B, or both," unless expressly indicated otherwise or indicated otherwise by context. Moreover, "and" is both joint and several, unless expressly indicated otherwise or indicated otherwise by context. Therefore, herein, "A and B" means "A and B, jointly or severally," unless expressly indicated otherwise or indicated otherwise by context.

The scope of this disclosure encompasses all changes, substitutions, variations, alterations, and modifications to the example embodiments described or illustrated herein that a person having ordinary skill in the art would comprehend. The scope of this disclosure is not limited to the example embodiments described or illustrated herein. Moreover, although this disclosure describes and illustrates respective embodiments herein as including particular components, elements, feature, functions, operations, or steps, any of these embodiments may include any combination or permutation of any of the components, elements, features, functions, operations, or steps described or illustrated anywhere herein that a person having ordinary skill in the art would comprehend. Furthermore, reference in the appended claims to an apparatus or system or a component of an apparatus or system being adapted to, arranged to, capable of, configured to, enabled to, operable to, or operative to perform a particular function encompasses that apparatus, system, component, whether or not it or that particular function is activated, turned on, or unlocked, as long as that apparatus, system, or component is so adapted, arranged, capable, configured, enabled, operable, or operative. Additionally, although this disclosure describes or illustrates particular embodiments as providing particular advantages, particular embodiments may provide none, some, or all of these advantages.

What is claimed is:

1. An apparatus, comprising:

an insert for an evaporator coil, wherein the insert comprises a solid core having a cross-sectional shape and a plurality of support legs, wherein the cross-sectional shape of the solid core is circular;

wherein:

the insert is located within the evaporator coil, the insert being twisted along a length of the insert, a first cross-sectional area of each of the plurality of support legs is smaller than a second cross-sectional area of the solid core, the solid core contacting the plurality of support legs along a length of the solid core and plurality of support legs, the insert configured so that refrigerant flows between an outer surface of the insert and an inner surface of the evaporator coil;

wherein, the insert reduces refrigerant charge in the evaporator coil by reducing a volume of refrigerant within the evaporator coil;

wherein, the insert causes refrigerant flowing through the evaporator coil to change direction;

wherein the solid core comprises a first end upstream of the insert and a second end opposite to the first end downstream of the insert; and a first area of the solid core at the first end is greater than a second area of the solid core at the second end.

2. The apparatus of claim 1, wherein the insert is secured to the inner surface of the evaporator coil using compression.

3. The apparatus of claim 1, wherein the solid core comprises one or more of the following materials: copper, steel, and aluminum.

4. The apparatus of claim 1, wherein a cross-sectional shape of the plurality of support legs is circular.

5. A system, comprising:

an evaporator coil; and an insert for the evaporator coil, wherein the insert comprises a solid core having a cross-sectional shape and a plurality of support legs, wherein the cross-sectional shape of the solid core is circular;

wherein:

the insert is located within the evaporator coil, the insert being twisted along a length of the insert, a first cross-sectional area of each of the plurality of support legs is smaller than a second cross-sectional area of the solid core, the solid core contacting the plurality of support legs along a length of the solid core and plurality of support legs, the insert configured so that refrigerant flows between an outer surface of the insert and an inner surface of the evaporator coil; and wherein, the insert reduces refrigerant charge in the evaporator coil by reducing a volume of refrigerant within the evaporator coil;

wherein, the insert causes refrigerant flowing through the evaporator coil to change direction;

wherein the solid core comprises a first end upstream of the insert and a second end opposite to the first end downstream of the insert; and a first area of the solid core at the first end is greater than a second area of the solid core at the second end.

6. The system of claim 5, wherein the insert is secured to the inner surface of the evaporator coil using compression.

7. The system of claim 5, wherein the solid core comprises one or more of the following materials: copper, steel, and aluminum.

8. The system of claim 5, wherein a cross-sectional shape of the plurality of support legs is circular.

9. A method, comprising:

locating an insert within an evaporator coil, wherein the insert comprises a solid core having a cross-sectional shape and a plurality of support legs, wherein the cross-sectional shape of the solid core is circular, the insert being twisted along a length of the insert, a first cross-sectional area of each of the plurality of support legs is smaller than a second cross-sectional area of the solid core, the solid core contacting the plurality of support legs along a length of the solid core and plurality of support legs, the insert configured so that refrigerant flows between an outer surface of the insert and an inner surface of the evaporator coil;

wherein:

the insert reduces refrigerant charge in the evaporator coil by reducing a volume of refrigerant within the evaporator coil;

the insert causes refrigerant flowing through the evaporator coil to change direction;

the solid core comprises a first end upstream of the insert and a second end opposite to the first end downstream of the insert; and a first area of the solid core at the first end is greater than a second area of the solid core at the second end.

10. The method of claim 9, wherein the insert is secured to the inner surface of the evaporator coil using compression.

11. The method of claim 9, wherein a cross-sectional shape of the plurality of support legs is circular.

* * * * *